United States Patent [19]

Tanczyn

[11] 4,043,843

[45] Aug. 23, 1977

[54] ABRASION RESISTANT, HEAT HARDENABLE, STAINLESS STEEL

[75] Inventor: Harry Tanczyn, Baltimore, Md.

[73] Assignee: Armco Steel Corporation, Middletown, Ohio

[21] Appl. No.: 711,636

[22] Filed: Aug. 4, 1976

Related U.S. Application Data

[60] Continuation-in-part of Ser. No. 555,708, March 5, 1975, abandoned, which is a division of Ser. No. 354,243, April 25, 1973, abandoned.

[51] Int. Cl.[2] ..... C22C 38/28; C22C 38/34

[52] U.S. Cl. ..... 148/37; 75/126 A; 75/126 D; 75/126 Q; 75/128 C; 75/128 D; 75/128 T

[58] Field of Search ..... 75/126 A, 126 D, 126 Q, 75/126 C, 128 C, 128 D, 128 T, 128 W; 148/37

[56] References Cited

U.S. PATENT DOCUMENTS 3,692,515 9/1972 Fletcher ..... 75/126 A

*Primary Examiner*—Arthur J. Steiner

*Attorney, Agent, or Firm*—Melville, Strasser, Foster & Hoffman

[57] ABSTRACT

A method of increasing the abrasion resistance of a heat hardenable chromium-bearing stainless steel, comprising adding at least one of silicon and titanium to a stainless steel melt containing from 0.75% to 10% carbon, 11.5% to 18% chromium, and balance essentially iron, silicon being from about 0.3% to about 4.5%, titanium being from about 0.75% to about 10%. The additions are proportioned such that silicon exceeds 1.5% when titanium exceeds about 1.5% at about 0.75% to about 1.5% carbon, and silicon exceeds 1.5% when titanium exceeds about 4% at carbon greater than 1.75%. A heat hardened steel article or fabricated product having excellent abrasion resistance consists essentially of about 1.8% to about 10% carbon, up to about 1.0% manganese, about 0.45% to about 4.5% silicon, about 11.5% to about 18% chromium, up to about 1% nickel, 1% to about 10% titanium, up to about 1.5% molybdenum, and balance essentially iron, with silicon exceeding 1.5% when titanium exceeds about 4%.

5 Claims, 2 Drawing Figures

ABRASION RESISTANT, HEAT HARDENABLE, STAINLESS STEEL

CROSS-REFERENCE TO RELATED APPLICATIONS

This application is a continuation-in-part of application Ser. No. 555,708 filed Mar. 5, 1975, now abandoned which in turn is a divisional application of application Ser. Nol 354,243 filed Apr. 25, 1973, now abandoned.

BACKGROUND OF THE INVENTION

1. Field of the Invention

This invention relates to a method of increasing the abrasion resistance of a chromium-bearing heat hardenable stainless steel while retaining good corrosion resistance and ability to be readily converted to wrought products by hot and cold working with conventional steel mill equipment. Steel treated by the method of the invention is martensitic in the heat hardened condition. The invention further relates to a steel of critical composition which has particular utility for fabrication into bearings, ball joints, tire studs, cutlery, materials processing equipment such as mining and ore processing machinery, and similar products the ultimate use wherein the above combination of properties is needed.

2. Description of the Prior Art

Currently available alloys capable of withstanding high stress, abrasive conditions are produced as castings only and are not amenable to production in wrought form. Among such prior art iron-base alloys are chromium-molybdenum white cast iron (analyzing about 3.2% carbon, about 0.6% silicon, about 15.0% chromium, about 3.0% molybdenum, and balance iron), and high chromium white cast iron (analyzing about 2.7% carbon, about 0.65% silicon, about 27.0% chromium and balance iron). Other such alloys are tool steels, e.g. AISI Type D-2(1.50—1.60% carbon, 0.30–0.45% silicon, 11.50–12.50% chromium, 0.75–0.85% molybdenum, 0.70–0.90% vandium, and balance iron), and AISI Type D-4 (2.0–2.30% carbon, 0.20–0.45% silicon, 11.50–12.50% chromium, 0.70–0.90% molybdenum, 0.30–0.50% vandium and balance iron).

Prior art martensitic stainless steels classified as wrought steels, such as AISI Types 440 A, B and C, actually can be hot worked and cold worked in standard mill equipment only with great difficulty. Moreover, these steels, which contain up to about 1.2% carbon, are deficient in abrasion resistance under very high stress, abrasive conditions.

U.S. Pat. No. 3,692,515 issued Sept. 19, 1972 to S.G. Fletcher et al, discloses a steel alleged to have improved abrasion resistance, forgeability and workability consisting essentially of about 1% to about 4.25% carbon, about 1.5% maximum silicon, about 1.5% maximum manganese, about 10% to about 15% chromium, less than 2% molybdenum, about 0.5% to about 5% titanium, less than 3% tungsten, less than 3% nickel, less than 5% cobalt, less than 5% vandium, up to 0.25% sulfur, and balance iron with residual impurities. A preferred composition contains 2.9% carbon, 0.4% silicon, 0.4% manganese, 12.5% chromium, 1.1% molybdenum, 3% titanium, and balance substantially iron with residual impurities. It is stated that carbon is added in excess of that necessary to give a desired hardenability and that such excess carbon is combined with titanium in a weight ratio of 4:1 and vanadium in a weight ratio of 4.2 (V-1):1. The cast alloy is reduced in cross sectional area by at least 5% by working, and heat treated by austenitizing at 1600° to 1950° F and tempering at 900° to 950° F.

The maximum austenitizing temperature of 1950° F disclosed in the Fletcher patent limits the amount of dissolved carbon to about 0.7% to 0.8% maximum. If no vanadium is present, the excess carbon content in the preferred practice would be Ti/4, or 3/4 (the preferred titanium content being 3%), i.e. 0.75%. Thus the total carbon content should be 1.45% to 1.55%. Since the excess carbon cannot all be dissolved and since the amount of titanium is insufficient to combine with all the excess carbon, that portion of the carbon not in solution and not in the form of titanium carbides would appear as ledeburitic carbides of iron, chromium, and such optional elements as vanadium, molybdenum and tungsten.

The limited disclosure of the Fletcher patent regarding heat treatment gives no indication of the microstructure of the tempered product and would apparently result in the presence of retained austenite.

There is thus a real need for a method of increasing the resistance to erosion by mechanical and/or mechanical-chemical abrasion in a heat hardenable stainless steel, which also exhibits ease of manufacture and fabrication into articles of ultimate use, and good corrosion resistance.

SUMMARY

It is a principal object of the present invention to provide a method of increasing the abrasion resistance of a heat hardenable stainless steel which, by selection of heat treatment, and observance of critical proportioning of carbon, titanium and silicon, will exhibit a degree of hardness and abrasion resistance suited to a particular application, together with good hot and cold workability and good corrosion resistance.

It is a further object to provide a steel article which in heat hardened and stress relieved condition exhibits excellent abrasion resistance by reason of a substantially fully martensitic matrix and an absence of ledeburitic carbides.

The above and other incidental objects of the invention, which will be apparent from the discussion which follows, are obtained in a method of increasing the abrasion resistance of a heat hardenable stainless steel while retaining good corrosion resistance, which comprises the steps of providing a stainless steel melt containing, in weight percent, from about 0.75% to about 10% carbon, up to about 1.0% manganese, about 11.5% to about 18% chromium, up to about 1% nickel, up to about 1.5% molybdenum, and balance iron except for incidental impurities, adding at least one of silicon and titanium, silicon when added being in the range of about 0.3% to about 4.5%, titanium when added being in the range of about 0.75% to about 10%, proportioning the silicon and titanium additions in such manner that silicon exceeds 1.5% when titanium exceeds about 1.5% for a carbon range of about 0.75% to about 1.5%, and that silicon exceeds 1.5% when titanium exceeds about 4% for a carbon content above about 1.75%, casting the steel, heat treating the steel by austenitizing within the temperature range of about 1600° to about 2250° F to dissolve sufficient carbon to prevent lowering of the martensitic transformation point and to leave a predetermined proportion of undissolved carbon in the form of uniformly dispersed particles of titanium-rich carbides of microscopic size, and cooling at a rate sufficient to form a substantially fully martensitic matrix.

Within the above broad composition range, a practicable upper limit of 5% carbon should be observed for wrought products formed by hot and cold working in standard mill equipment. With carbon contents above 5%, the steel can be produced in the cast-to-shape condition, or in a form suitable for powder metallurgy techniques, and can be hardened and tempered.

An important aspect of the present invention is the discovery that the increase in abrasion resistance resulting from addition of titanium is restricted to a relatively narrow range and that an increase in the titanium content above this range (which varies with the carbon content) results in a decrease in abrasion resistance, i.e., a reversal of the desired effect. However, in accordance with the present invention, addition of silicon in amounts greater than 1.5% results in progressive increases in abrasion resistance with progressive increases in titanium content. The combined silicon and titanium additions, within the limits defined herein, must thus be regarded as synergistic, i.e., better abrasion resistance is achieved than with addition of an equal amount of either silicon on titanium alone.

In accordance with the invention, a steel article or fabricated product produced by the method hereinbefore defined, having an abrasion resistance of less than 4,500 milligrams per 1,000 cycles by the hereinafter described test, and good corrosion resistance, consists essentially of, in weight percent, from about 1.8% to about 10% carbon, up to about 1.0% manganese, about 0.45% to about 4.5% silicon, about 11.5% to about 18% chromium, up to about 1nickel, from about 1% to about 10% titanium, up to about 1.5% molybdenum, and balance essentially iron except for incidental impurities, with silicon exceeding 1.5% when titanium exceeds about 4%, said article or product having a substantially fully martensitic matrix containing uniformly dispersed particles of titaniumrich carbides of microscopic size.

BRIEF DESCRIPTION OF THE DRAWING

Reference is made to the accompanying drawing wherein.

DESCRIPTION OF THE PREFERRED EMBODIMENTS

Figure 1:
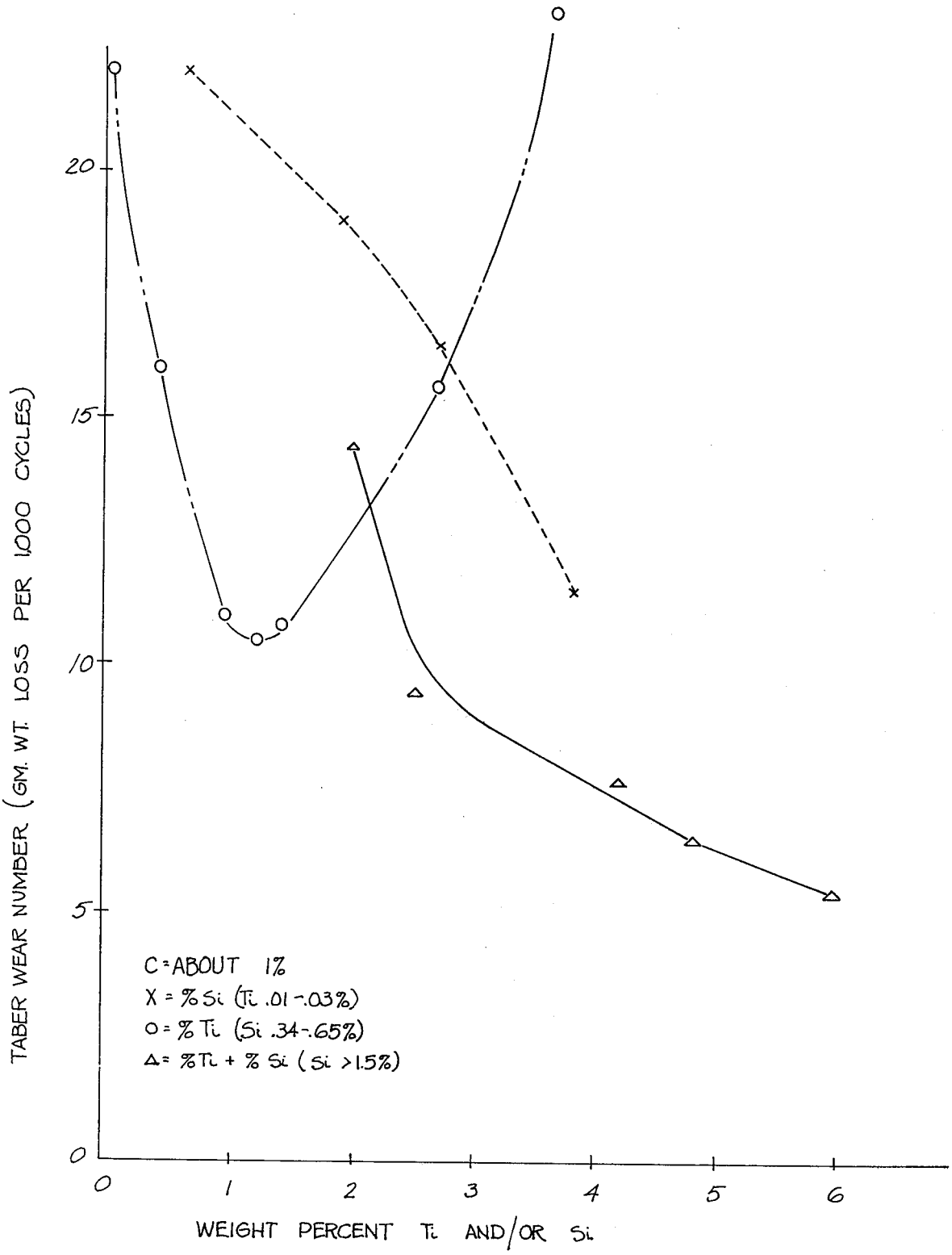
FIG. 1 is a graphic illustration of the effects of varying titanium and silicon additions on abrasion resistance in a chromium-iron alloy containing about 1% carbon.

While not wishing to be bound by theory, it is believed that the function of silicon in improving abrasion or wear resistance is the development of great oxidation resistance during wear testing. This results in decrease in the loss of matrix metal by an oxidation process and provides extended holding of the small titanium-enriched carbide particles in place within the matrix. Thus, silicon additions lower the rate of loss of matrix metal which, in turn, lowers the rate of loss of carbide particles by mechanical erosion.

The stabilizing influence of silicon in retaining or improving abrasion resistance at higher titanium levels is believed to be due to the formation of silicon-titanium intermetallic compounds which apparently provide continued abrasion resistance.

The reason for the decrease in abrasion resistance observed for high titanium additions (without compensating increases in silicon content) is unknown but may be due to depletion of the carbon content of the matrix metal, or lowering of the martensitic transformation temperature thus resulting in retained austenite in the heat treated product.

Heat treatment of a steel of the broad and preferred composition ranges set forth above produces a martensitic stainless steel matrix, containing uniformly dispersed extremely hard abrasion resistant particles of titanium carbide. These titanium carbide particles are microscopic in size and roughly spherical in shape. The creation of a martensitic matrix of high hardness and high compressive yield strength has been found to be necessary to provide the desired high abrasion resistance. In this condition the hard particles of titanium carbide are not forced into the matrix under applied heavy service loads.

Since titanium combines with carbon in a 1:1 atomic ratio, and since titanium carbide is of extreme hardness, a highly effective resistance against abrasion can be achieved at a relatively low alloying level. Moreover, the degree of abrasion or wear resistance can be preselected for any given application by varying the carbon and titanium contents and by the heat treatment to which the steel is subjected, thereby controlling the hardness of the martensitic steel matrix and the relative volume of small titanium carbides dispersed in the matrix.

While the presence of iron and chromium make it difficult to develope "pure" titanium carbides as the bearing-particle or abrasion-resistance phase, nevertheless this condition can be approached to the extent that only very small proportions of iron and chromium exist in the carbide phase. As is well known, the weight ratio of titanium to carbon in titanium carbide is about 4:1. In order to harden and strengthen the matrix a selected carbon level associated with iron and chromium needs to be taken into solution at the hardening temperature. Thus the titanium content will be less than 4 times the total carbon content. The solubility of carbon in iron increases with an increase in hardening temperature, and this provides the mechanism for controlling the proportion of carbon combined with titanium and hence the relative volume of the titanium carbide or bearing-particle phase. At a selected temperature level of soluble carbon, the undissolved or insoluble carbon is combined with the titanium in the form of titanium carbide or titanium-enriched carbides. It should also be understood that any nitrogen present as an impurity will also react with titanium to produce some titanium cyanonitrides and/or titanium nitrides under ordinary commercial melting practice.

More specifically, heat treatment temperatures for hardening the martensitic matrix range from about 1600° to about 2250° F. A greater proportion of carbon is dissolved at the upper limit of this range, and some chromium is dissolved with the carbon, thereby improving the corrosion resistance and hardness of the matrix. On the other hand, titanium carbides cannot dissolve in the matrix until temperatures higher than about 2050° F are attained. While not wishing to be bound by theory, it is believed that about 0.10% carbon is dissolved at 1600° F, about 0.8% carbon is dissolved at 1900° F, and about 1.5% carbon is dissolved at 2200° F. Any undissolved carbon remains in the form of titanium carbide. After the desired hardening temperature is reached the steel is cooled by any conventional system including air, a moving gas stream, oil and the like. Thereafter, stress-relieving heat treatment at about 550° to 700° F may be applied to hardened sections, as needed for specific applications.

It is an essential feature of the invention that the heat treatment or austenitizing temperature be so selected as to take enough carbon into solution that the martensite transformation temperature ($M_s$) will not be lowered, thus insuring the formation of a substantially fully martensitic matrix on cooling. The cooling rate is not a limitation since the rate of martensite transformation is the governing factor, and this is dependent on the alloy content of the steel. In general, a cooling rate at least as rapid as air cooling is preferred.

Assuming a steel having a total carbon content of not greater than 5%, after melting and casting, it can be hot rolled, cold rolled, heat treated to dissolved a predetermined percentage or proportion of carbon in the matrix and to leave a selected proportion of the total carbon content in the form of titanium carbides. Alternatively, at relatively low carbon contents, all the carbon can be dissolved by heat treatment and a selected proportion can be precipitated as titanium carbide by a controlled cooling rate from the hardening temperature, or by a selected secondary heat treatment.

Examplary heat treatments which may be applied are as follows:

A — heat to 1900° F, hold 30 minutes, air cool

B — heat to 1900° F, hold 30 minutes, air cool, stress relieve at 600° F

C — heat to 1900° F, hold 30 minutes, air cool to 1300° F, hold 1 hr., and air cool or oil quench to room temperature D — heat to 1900° F, hold 30 minutes, air cool to 1300° F, hold 1 hr., air cool or oil quench to room temperature, and stress-relieve at 600° F As will be apparent from the above discussion, the titanium, silicon and carbon contents, and critical proportioning thereof, with consequent formation of titanium carbide particles and formation of a hard matrix, are responsible for the excellent abrasion resistance of the steel of the invention. However, in addition the titanium and carbon contents are further responsible for the ease with which the steel can be hot and cold worked. Parenthetically it should be noted at this point that no prior art martensitic stainless steel containing more than about 205% carbon can be produced in wrought form. (The previously mentioned Fletcher patent, while alleging workability up to 4.25% carbon, actually discloses carbon contents of only 2.35% and 2.7% in the specific examples.) Accordingly, a permissible increase in carbon up to and including the 5% level, while still retaining hot and cold workability, represents a significant contribution to the art. In the practice of the present invention the titanium addition increases the workability of the steel by raising the temperature at which the alloy can be hot worked. By way of example, the previously mentioned AISI D-2 and D-4 tool steels are hot worked or forged from 1950° and from 1900° F, respectively, whereas the steel of the present invention is hot worked from 2100° to 2250° F. If the prior art D-2 and D-4 tool steels were hot worked from 2150° to 2250° F, they would overheat and break up during working. Moreover, the titanium addition significantly increases the cold workability of the steel. For example, AISI Type 440C (containing about 1% carbon) can accept only a 15% cold reduction between anneals, whereas a steel of the present invention containing about 1% carbon and about an equal amount of titanium can be cold reduced 40% between anneals.

It is believed that the beneficial effects of titanium on the hot and cold workability of the steel arise from the shape and size of the titanium carbides in the matrix. Since these are small and spherical in shape the titanium carbides permit easy flow of the matrix around them during hot and cold working. Prior art cast alloys and so-called wrought Types 440 A, B or C contain ledeburitic carbide structures, i.e., large platelets, which impede the flow of metal around them, thereby causing cracking and breaking of the matrix during hot and cold working. Such ledeluritic carbide structures are common to hypereutectoid steels generally.

Chromium is also an essential element, a minimum of about 11.5% being necessary to impart good corrosion resistance and hardenability to the matrix. In this respect chromium lowers the eutectoid carbon level (from about 0.78% carbon in pure iron) to about 0.35% carbon at about 13% chromium. More than 18% chromium is undesirable since it would adversely affect the hot and cold working properties of the steel and unnecessarily increase the cost of the alloy with no attendant benefit.

Silicon functions in the same manner as chromium in lowering the eutectoid carbon level and apparently is synergistic with chromium in this function.

Manganese, nickel, phosphorus and sulfur are nonessential elements in the steel of the invention. A maximum of about 1% manganese can be tolerated and about 0.30% is preferred. Manganese in excess of 1% would be harmful because of its effect of stabilizing the high temperature phase austenite. Up to about 1% nickel may be present as an impurity without adverse effect, and phosphorus and sulfur similarly can be tolerated in amounts up to about 0.10% and 0.5%, respectively.

Zirconium may be substituted in part for titanium. Other carbide formers such as vandium and molybdenum may also be added or substituted in part for titanium, in amounts up to about 1.5% each, for special purposes such as increase in corrosion resistance. Columbium should not be added since it adversely affects the hot workability of the steel.

A series of heats have been prepared and tested for abrasion resistance, hot forgeability and heat hardening. For purposes of comparison, several prior art alloys have been similarly tested. The compositions of these heats are set out in Table I below.

Properties of the steels of Table I are set forth in Table II below. For all samples specimens were hot-forged to ½ inch diameter by 6-inch rounds, annealed at 1450° F, machined, heat treated at 1900° F, held for 30 minutes, and then air cooled. Finally, the surfaces of the specimens were smoothed with 120 grit paper in order to provide uniform surface conditions among all the specimens.

Abrasion tests were carried out on the Taber Met-Abrader Model 500, using the weight loss method. For each specimen the loss of weight was measured in milligrams per 1000 cycles, so that the lower the wear number, the better the abrasion resistance of the specimen.

Hot forgeability was rated empirically as good, fair or poor.

Rockwell C hardnesses were determined in the hardened condition both for the maximum obtainable under the specified heat treatment conditions and for the specimens prepared for the Taber Met-Abrader.

TABLE I

| Compositions - Weight Percent | | | | | |
|---|---|---|---|---|---|
| Sample | Heat No. or Type Steel | C | Si | Cr | Ti |
| 1 | 8249-2 | 0.98 | 1.06 | 15.12 | 0.92 |
| 2* | 8348 | 2.14 | 0.55 | 11.54 | 1.26 |
| 3* | 8349 | 2.34 | 0.50 | 12.03 | 2.14 |
| 4* | 8350 | 2.35 | 0.51 | 12.00 | 3.84 |
| 5 | 8312 | 0.91 | 0.36 | 16.92 | 0.87 |
| 6 | 8508 | 2.06 | 0.75 | 12.55 | 5.20 |
| 7* | 8509 | 3.21 | 0.75 | 12.95 | 2.57 |
| 8 | 8644-1 | 1.02 | 0.42 | 11.94 | 0.98 |
| 9 | 8644-2 | 1.01 | 1.62 | 11.88 | 0.92 |
| 10 | 031027 | 1.16 | 0.31 | 16.36 | 0.98 |
| 11 | 032026 | 1.19 | 1.03 | 13.98 | 0.87 |
| 12 | 8248-1 | 0.51 | 1.18 | 14.88 | 0.48 |
| 13 | 8248-2 | 0.97 | 1.15 | 14.82 | 0.42 |
| 14 | 8249-1 | 0.49 | 1.12 | 15.04 | 0.96 |
| 15 | 8311 | 0.95 | 0.32 | 16.85 | 0.33 |
| 16 | 8516 | 0.35 | 0.54 | 13.25 | 0.51 |
| 17 | 8521-2 | 1.02 | 3.86 | 11.87 | nil |
| 18 | 8643-1 | 1.03 | 0.38 | 12.00 | 0.47 |
| 19 | 8643-2 | 1.01 | 1.58 | 11.92 | 0.43 |
| 20 | Stellite 6B | 1.2 | 0.90 | 30.0 | nil + 60.0 Co, 4.5W, balance Fe |
| 21 | D-4 | 2.2 | 0.30 | 12.00 | nil + 0.80 Mo, 0.40 V, balance Fe |
| 22 | Cr-Mo While Cast Iron | 3.2 | 0.60 | 15.00 | nil + 3.0 Mo, balance Fe |
| 23 | High-Cr While Cast Iron | 2.7 | 0.65 | 27.00 | nil + balance Fe |

*Steels of the present invention.

TABLE II

| Abrasion Resistance, Hot Working And Hardness Properties | | | | |
|---|---|---|---|---|
| | Wear Number mg/1000 Cycles | | Heat Hardening Rockwell C | |
| Sample | Taber Met-Abrader Model 500 | Hot Forgeability | Maximum | Taber Specimen |
| 1 | 10,100 | Good (G) | 59 | 56 |
| 2* | 4,090 | G | 67 | 62 |
| 3* | 3,400 | G | 67 | 62 |
| 4* | 3,000 | G | 67 | 62 |
| 5 | 10,400 | G | 59 | 56 |
| 6 | 4,100 | G | 60 | 57 |
| 7* | 3,100 | G | 66 | 61 |
| 8 | 11,000 | G | 60 | 57 |
| 9 | 9,500 | G | 59 | 56 |
| 10 | 11,500 | G | 58 | 56 |
| 11 | 10,000 | G | 59 | 56 |
| 12 | 40,700 | G | 56 | 50 |
| 13 | 13,700 | G | 58 | 55 |
| 14 | 32,700 | G | 56 | 50 |
| 15 | 16,500 | G | 59 | 56 |
| 16 | 49,000 | G | 53 | 46 |
| 17 | not determined | Fair | 50 | not determined |
| 18 | 16,000 | G | 60 | 57 |
| 19 | 14,500 | G | 59 | 56 |
| 20 | 28,000 | Poor | 46 | 46 |
| 21 | 10,800 | Poor | 67 | 62 |
| 22 | 6,100 | Poor | 63 | 60 |
| 23 | 9,400 | Poor | 58 | 55 |

*Steels of the Invention

Sample 17, containing no titanium, exhibited only fair forgeability, and low hardness. For these reasons, its abrasion resistance was not determined.

The critical proportioning of carbon, titanium and silicon, and the synergistic effect of silicon additions together with titanium in improving abrasion resistance, are shown by a series of additional test heats, the compositions and wear test results of which are set forth in Table III. For all samples, specimens were hot forged to ½ inch diameter, annealed at 1450° F, machined, heat treated by austenitizing at 1850° F, held for 30 minutes, and then oil quenched. The surfaces of the specimens were smoothed with 120 grit paper, and abrasion resistance tests were conducted on the Taber Met-Abrader Model 500.

A consideration of the data of Table III, together with Samples 2, 3, 4 and 6 of Tables I and II, show that addition of increasing amounts of either silicon or titanium improves the abrasion resistance of a nominal 1% carbon, chromium-bearing steel (comparison of Sample 24 with Samples 25–33 ), but that if the titanium addition exceeds about 1.5% and silicon is low (less than about 0.5%), abrasion resistance decreases. However, is silicon is added in excess of 1.5% when titanium exceeds 1.5%, then abrasion resistance is greatly improved (compare Samples 33, 34, 35 with Sample 36 ). This effect is illustrated graphically in FIG. 1 which is plotted from the data of Table III. It will be noted therefrom that titanium confers a greater increase in abrasion resistance (in amounts up to about 1.5%) than silicon, but that silicon and titanium together, each in an amount greater than 1.5%, exhibit a synergistic effect (Samples 36–38 ).

Figure 2:
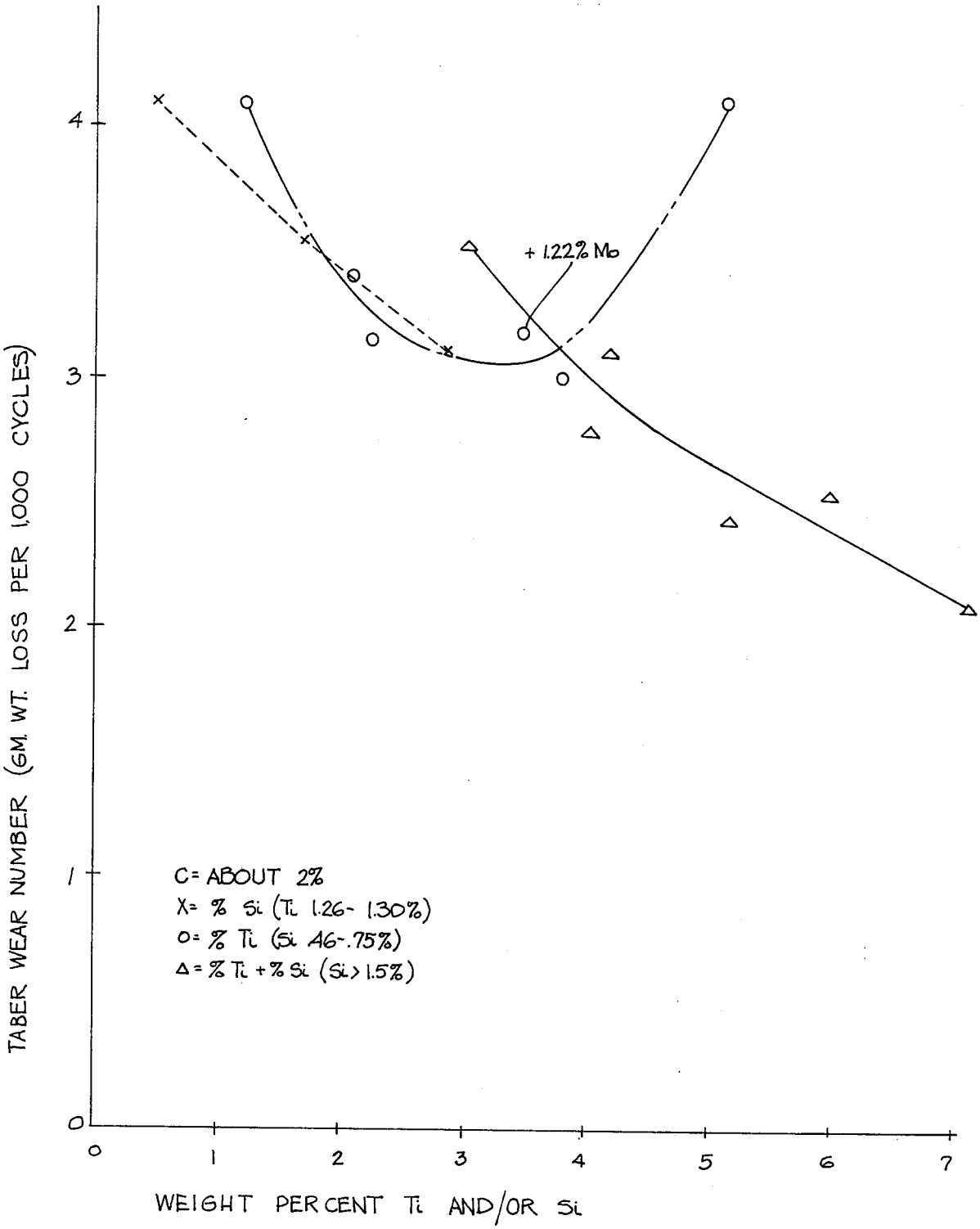
FIG. 2 is a graphic illustration of the effects of varying titanium and silicon additions on abrasion resistance in a chromium-iron alloy containing about 2% carbon.

Turning next to a consideration of a nominal 2% carbon, chromium-bearing steel, it is evident that addition of increasing amounts of either silicon or titanium increases abrasion resistance (again with titanium having a greater effect), but that when titanium exceeds about 4% and silicon is low (about 0.5%) abrasion resistance decrease (compare Samples 2, 3, 4 and 6). This is shown graphically in FIG. 2 which is plotted from Samples 2, 3, 4 and 6 and Table III. If silicon is added in excess of 1.5% when titanium exceeds about 4%, abrasion resistance is improved (compare Samples 4 and 6 with Samples 43 and 46). The synergistic effect of silicon and titanium at higher carbon levels is thus also evident. FIGS. 1 and 2 contain curves in which titanium plus silicon are plotted against abrasion resistance, and progressive increases in the sum total of both cause increased abrasion resistance throughout the range investigated.

TABLE III

Compositions - Weight Percent and Abrasion Resistance

| Sample | Heat No. | C | Si | Cr | Ti | | Wear Number mg/100 cycle Taber Met-Abrader Model 500 |
|---|---|---|---|---|---|---|---|
| 24 | 8520-1 | 0.96 | 0.65 | 12.31 | 0.01 | | 22,000 |
| 25 | 8520-2 | 0.94 | 1.95 | 11.60 | 0.01 | | 19,000 |
| 26 | 8521-1 | 1.00 | 2.76 | 12.00 | 0.02 | | 16,500 |
| 27 | 8521-2 | 1.02 | 3.86 | 11.87 | 0.03 | | 11,500 |
| 28 | 8643-1 | 1.03 | 0.38 | 12.00 | 0.47 | | 16,000 |
| 29 | 8643-2 | 1.01 | 1.58 | 11.92 | 0.43 | | 14,500 |
| 30 | 8644-1 | 1.02 | 0.42 | 11.94 | 0.98 | | 11,000 |
| 31 | 8644-2 | 1.01 | 1.62 | 11.88 | 0.92 | | 9,500 |
| 32 | 8688 | 0.94 | 0.34 | 11.92 | 1.22 | | 10,500 |
| 33 | 8689 | 0.87 | 0.56 | 12.60 | 1.43 | | 10,800 |
| 34 | 9361 | 1.02 | 0.42 | 11.72 | 2.72 | | 15,700 |
| 35 | 9362 | 1.00 | 0.42 | 11.50 | 3.68 | | 23,300 |
| 36 | 9363 | 1.02 | 1.78 | 11.80 | 2.44 | | 7,550 |
| 37 | 8690 | 0.95 | 3.11 | 11.99 | 1.72 | | 6,500 |
| 38 | 8694 | 0.81 | 4.41 | 11.96 | 1.54 | | 5,500 |
| 39* | 8781 | 2.30 | 0.46 | 11.87 | 2.28 | | 3,150 |
| 40* | 9365 | 2.05 | 0.67 | 13.10 | 3.54 | Mo 1.22 | 3,180 |
| 41* | 9375 | 2.23 | 1.78 | 12.08 | 1.29 | | 3,550 |
| 42* | 9377 | 2.28 | 1.75 | 12.01 | 2.31 | | 2,800 |
| 43* | 9379 | 2.12 | 1.83 | 11.97 | 4.18 | | 2,550 |
| 44* | 9376 | 2.19 | 2.91 | 12.04 | 1.30 | | 3,100 |
| 45* | 9378 | 2.22 | 2.89 | 12.01 | 2.31 | | 2,450 |
| 46* | 9380 | 2.32 | 2.96 | 11.94 | 4.26 | | 2,100 |

Residual elements in all above heats were 1% maximum Mn, 0.50% maximum Ni, 0.030% maximum P, 0.030% maximum S.
*Steels of the invention.

The method of the invention is thus evident from the above description and tests. It is further apparent that articles and fabricated products, such as materials processing equipment, having an abrasion resistance of less than 4,500 milligrams per 1,000 cycles by the Tabler Met-Abrader Model 500 test can be produced in heat hardened condition by the method of the invention from a steel consisting essentially of, in weight percent, from about 1.8% to about 10% carbon, up to about 1.0% manganese, about 0.45% to about 4.5% silicon, about 11.5% to about 18% chromium, up to about 1% nickel, from about 1% to about 10% titanium, up to about 1.5% molybdenum, and balance essentially iron except for incidental impurities, with silicon exceeding 1.5% when titanium exceeds about 4%.

Both cast and wrought articles of ultimate use may be involved having the above properties, the above composition being restricted to a maximum of about 5% carbon for hot worked and cold worked articles prior to the heat treatment step. If cold working is practiced, a stress relief treatment at about 550° to 700° F is preferably conducted after the heat hardening treatment. At carbon levels above 5%, cast articles of ultimate use, and particulate material suitable for powder metallurgy processing such as compacting and sintering, may be produced and subjected to heat hardening.

Where extremely high abrasion resistance and hardness are desired and hot and/or cold workability are not needed (as in commercial tungsten carbon tooling wherein carbide particles are bonded with nickel and/or cobalt, with the volume proportion of carbides being about 90%), high carbon and titanium embodiments of the steel of the invention can be substituted with resultant lower cost for total alloy additions. For such applications the above composition is utilized with a carbon range of greater than 5% to about 10%, and a titanium range of greater than 5% to about 10% or even higher.

As will be evident from Sample 40 in Table III molybdenum may be added in amounts up to about 1.5% without adverse effect on abrasion resistance, and such a modification can be used where improved corrosion resistance is desired.

The embodiments of the invention in which an exclusive property or privilege is claimed are defined as follows:

1. Heat hardened stainless steel fabricated product having good corrosion resistance, and an abrasion resistance of less than 4,500 milligrams per 1,000 cycles by the test herein described, consisting essentially of, in weight percent, from about 1.8% to about 5% carbon, up to about 1.0% manganese, greater than 1.5% to about 4.5% silicon, about 11.5% to about 18% chromium, up to about 1% nickel, greater than about 4% to about 10% titanium, up to about 1.5% molybdenum, and balance essentially iron exept for incidental impurities.

2. Heat hardened, hot worked and cold worked article of ultimate use, having good corrosion resistance, and an abrasion resistance of less than 4,500 milligrams per 1,000 cycles by the test herein described, consisting essentially of, in weight percent, from about 1.8% to about 5% carbon, up to about 1.0% manganese, greater than 1.5% to about 4.5% silicon, about 11.5% to about 18% chromium, up to about 1% nickel greater than 4% to about 10% titanium, up to about 1.5% molybdenum, and balance esssentially iron except for incidental impurities.

3. Heat hardened cast article of ultimate use, having good corrosion resistance, and an abrasion resistance of less than 4,500 milligrams per 1,000 cycles by the test herein described, consisting essentially of, in weight percent, from greater than 5% to about 10% carbon, up to about 1.0% manganese, about 0.45% to about 4.5% silicon, about 11.5% to about 18% chromium, up to about 1% nickel, about 1% to about 10% titanium, up to about 1.5% molybdenum, and balance essentially iron except for incidental impurities, with silicon exceeding 1.5% when titaium exceeds about 4%.

4. Heat hardened stainless steel article having good corrosion resistance, and an abrasion resistance of less than 4,500 milligrams per 1,000 cycles by the test herein described, consisting essentially of, in weight percent, from about 1.8% to about 10% carbon, up to about 1.0% manganese, greater than 1.5% to about 4.5% silicon, about 11.5% to about 18% chromium up to about 1% nickel, greater than about 4% to about 10% titanium, up to about 1.5% molybdenum, and balance essentially iron except for incidental impurities.

5. Heat hardened stainless steel tooling having good corrosion resistance, and an abrasion resistance of less than 4,500 milligrams per 1,000 cycles by the test herein described, consisting essentially of, in weight percent, from greater than 5% to about 10% carbon, up to about 1.0% manganese, greater than 1.5% to about 4.5% silicon, about 11.5% to about 18% chromium, up to about 1% nickel, greater than 5% to about 10% titanium, up to about 1.5% molybdenum, and balance essentially iron except for incidental impurities.

* * * * *

UNITED STATES PATENT OFFICE

CERTIFICATE OF CORRECTION

Patent No. 4,043,843 Dated August 23, 1977

Inventor(s) HARRY TANCZYN

It is certified that error appears in the above-identified patent and that said Letters Patent are hereby corrected as shown below:

Column 3, line 33, "1 nickel" should read --1% nickel--.

Column 3, line 56, "great" should read --greater--.

Column 5, line 18, "dissolved" should read --dissolve--.

Column 5, line 48, "205%" should read --2.5%--.

Column 8, line 11, "is" should read --if--.

Column 10, line 64, "titaium" should read --titanium--.

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*